US008032990B2

(12) United States Patent
Shinma et al.

(10) Patent No.: US 8,032,990 B2
(45) Date of Patent: Oct. 11, 2011

(54) HANDLES FOR HAND-HELD TOOLS

(75) Inventors: Yasutoshi Shinma, Anjo (JP); Keiji Nakashima, Anjo (JP); Hajime Takeuchi, Anjo (JP)

(73) Assignee: Makita Corporation, Anjo-Shi (JP)

( * ) Notice: Subject to any disclaimer, the term of this patent is extended or adjusted under 35 U.S.C. 154(b) by 57 days.

(21) Appl. No.: 12/078,054

(22) Filed: Mar. 26, 2008

(65) Prior Publication Data

US 2009/0000434 A1 Jan. 1, 2009

(30) Foreign Application Priority Data

Mar. 29, 2007 (JP) ..... 2007-087904

(51) Int. Cl.
*B25G 1/00* (2006.01)

(52) U.S. Cl. ..... 16/426

(58) Field of Classification Search ..... 16/426, 16/406, 422; 294/58; 81/177.1, 177.2, 489, 81/491, 487; 408/241 R; 173/18, 171
See application file for complete search history.

(56) References Cited

U.S. PATENT DOCUMENTS 982,145 A * 1/1911 Langlois ..... 294/58
1,083,054 A * 12/1913 Brown ..... 294/58
4,794,667 A * 1/1989 Nelson et al. ..... 16/426
5,695,231 A * 12/1997 Hoffman ..... 294/58
6,108,871 A * 8/2000 Weakland et al. ..... 16/441
6,553,627 B1 * 4/2003 Horler ..... 16/426
6,751,827 B1 * 6/2004 Fok ..... 16/413
D618,530 S * 6/2010 Stirm ..... D8/69
2004/0163214 A1 * 8/2004 Cheng ..... 16/426
2009/0307875 A1 * 12/2009 Nakashima et al. ..... 16/436
2010/0064480 A1 * 3/2010 Martin ..... 16/426
2010/0064482 A1 * 3/2010 Martin ..... 16/426

FOREIGN PATENT DOCUMENTS

EP 1 400 317 A1 3/2004
GB 2 165 480 A 4/1986
JP 09174463 A * 7/1997
JP A-2000-176864 6/2000

* cited by examiner

*Primary Examiner* — Victor Batson
*Assistant Examiner* — Matthew Sullivan
(74) *Attorney, Agent, or Firm* — Oliff & Berridge, PLC

(57) ABSTRACT

A handle for a tool includes a handle body, an operation device and a pair of clamp halves. The operation device has an operation member operable by an operator. At least one of the clamp halves can move relative to the handle body along an axis. As the operation member is operated, the one of the handle halves moves along the axis, so that the distance between the handle halves can be changed for clamping or releasing a portion of the tool.

14 Claims, 11 Drawing Sheets

HANDLES FOR HAND-HELD TOOLS

This application claims priority to Japanese patent application serial number 2007-087904, the contents of which are incorporated herein by reference.

BACKGROUND OF THE INVENTION

1. Field of the Invention

The present invention relates to handles for hand-held tools, such as hammer drills, and in particular to handles that can be removably mounted to hand-held tools.

2. Description of the Related Art

In the case of a known hammer drill that has a relatively large size and is designed to be held with both hands of an operator during the operation, an auxiliary handle is provided in addition to a main handle. Therefore, the operator can grasp the main handle with one hand and can grasp the auxiliary handle with the other hand. In general, such an auxiliary handle is provided as an optional component and can be mounted to and removed from the tool. Two different types of auxiliary handles are generally used for different modes of operations. One type is a bar-type handle that has a grip portion extending laterally from the tool. The other type is a D-shaped handle that has a pair of support arms and a grip portion extending between the support arms. The support arms extend laterally from the tool and are spaced from each other by a predetermined distance. The bar-type handle is suitable to handle-held tools that may receive a rotational torque (e.g., about an axis of a tool bit) from a workpiece during the operation. The D-shaped handle is suitable to hand-held tools that may receive vibrations in the vertical direction (e.g., due to a reaction force applied to a tool bit in an axial direction) from a workpiece during the operation.

Japanese Laid-Open Publication No. 2000-176864 teaches a known D-shaped auxiliary handle as shown in FIG. 11, which corresponds to FIG. 1 of this publication. Referring to FIG. 11, an auxiliary handle 10 has a clamp portion 11 for clamping a front case 2 of a hand-held tool 1, an operation device 12 for operating the clamp portion 11, and a grip portion 13 adapted to be grasped by the operator. The clamp portion 11 has a pair of clamp halves 11*a* that can clamp the front case 2 therebetween from opposite sides. The front case 2 has a substantially cylindrical tubular configuration. The clamp halves 11*a* are held in the clamping position by tightening a fixing nut 12*a* of the operation device 12. The clamp portion 11 can be removed from the front case 2 by loosening the fixing nut 12*a*, so that the auxiliary handle 10 can be removed from the hand-held tool 1.

Referring again to FIG. 11, a main handle 3 is disposed on the rear end (right end as viewed in FIG. 11) of the hand-held tool 1. In order to operate the tool 1, the operator can grasp the main handle 3 with one hand and can grasp the grip portion 13 of the auxiliary handle 10 with the other hand, so that the operator can hold the tool 1 with both hands.

However, with the above known auxiliary handle 10, the support arms 14 and 15 extend laterally from opposite ends in the vertical direction of the support portion 12, and the grip portion 13 is fixed to the tip ends of the support arms 14 and 15 and extends therebetween. In addition, as the fixing nut 12*a* is tightened, the support arms 14 and 15 may be flexed toward each other, so that the clamp halves 11*a* of the clamp portion 11 can clamp the hand-held tool 1. Therefore, the tolerance of the opening and closing movement of the clamp halves 11*a* of the clamp portion 11 given by the operation of the operation device 12 (i.e., the tolerance of the flexing amount of the support arms 14 and 15) is not sufficient.

Practically, the clamp halves 11*a* of the clamp portion 11 cannot be largely opened relative to the front case 2 of the hand-held tool 1 unless the auxiliary handle 10 is disassembled. Therefore, the mounting and removing operations of the auxiliary handle 10 is troublesome and require much time.

In addition, due to the small tolerance of the opening and closing movement of the clamp halves 11*a*, the sizes of hand-held tools, to which the auxiliary handle 10 can be mounted, are limited within a narrow range.

Therefore, there has been a need for handles that can be easily mounted to and removed from hand-held tools and are improved in versatility.

SUMMARY OF THE INVENTION

One aspect according to the present invention includes a handle for a tool. The handle includes a handle body, an operation device and a pair of clamp halves. The operation device has an operation member operable by an operator. At least one of the clamp halves can move relative to the handle body along an axis. As the operation member is operated, the one of the handle halves moves along the axis, so that the distance between the handle halves can be changed for clamping or releasing a portion of the tool.

DETAILED DESCRIPTION OF THE INVENTION

Figure 1:
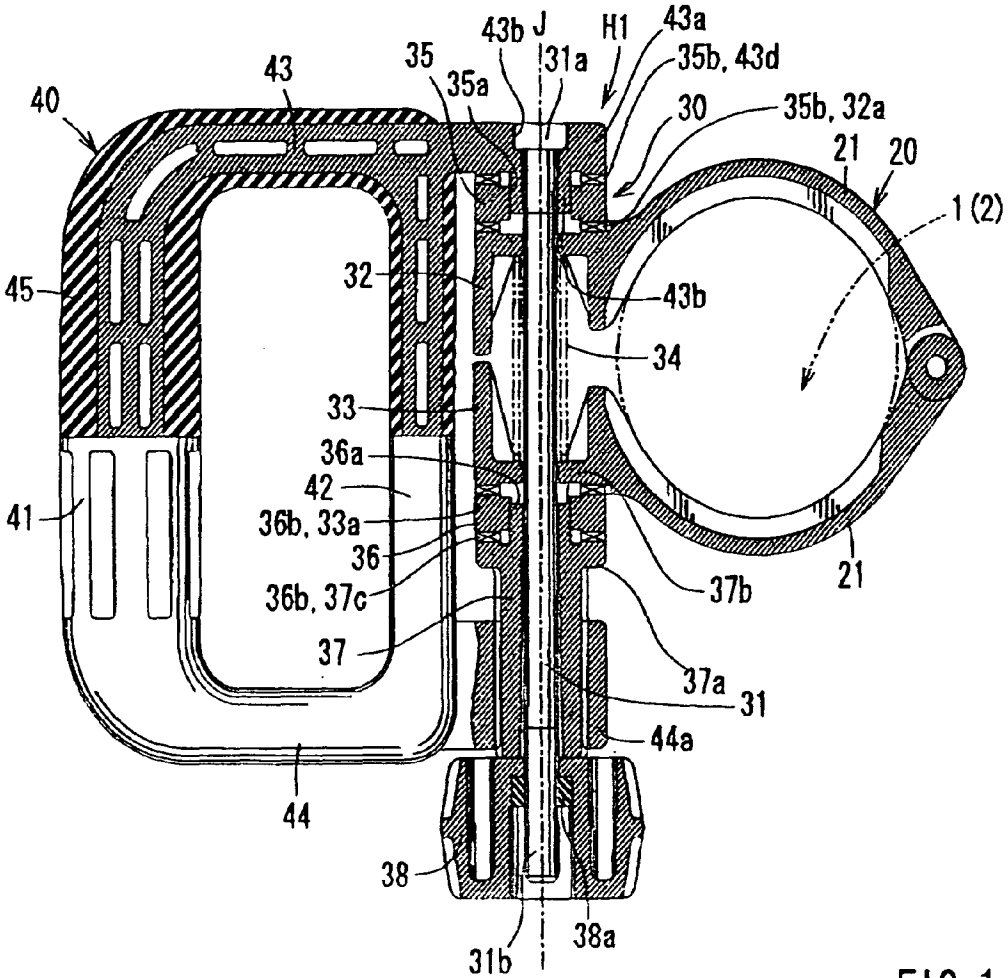
FIG. 1 is a side view of a handle according to a first embodiment of the present invention and showing the state where the handle has been mounted to a mount portion of a hand-held tool by tightening an operation knob for closing clamp halves.

Each of the additional features and teachings disclosed above and below may be utilized separately or in conjunction with other features and teachings to provide improved handles for hand-held tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a handle for a hand-held tool includes a pair of clamp halves, and operation device and a handle body. The clamp halves serves to clamp and fix a mount portion of the hand-held tool from opposite sides of the mount portion. The operation device has an operation member operable for opening and closing the clamp halves relative to the mount portion. The handle body is configured to be grasped by an operator and includes a pair of support arms and a grip portion. The support arms are configured to support the operation device. The grip portion is fixed between the support arms. The operation device is configured such that the clamp halves can move to open or close relative to the mount portion independently of the support arms.

With this arrangement, the clamp halves can open and close independently of the support arms of the handle body. Therefore, the clamp halves can be closed to clamp the mount portion of the tool therebetween without causing the support arms to be flexed. Also, the clamp halves can be opened to release the mount portion of the tool without causing the support arms to be flexed.

Because the clamp halves can be opened and closed without causing the support arms to be flexed, it is possible to set a large tolerance of movement of the clamp halves for opening the clamp halves. Therefore, it is possible to easily remove the handle from the tool without need of disassembling the handle. In addition, it is possible to mount the handle in the assembled state of the clamp halves with the handle body.

Further, because a large tolerance of movement of the clamp halves can be ensured for opening the clamp halves, the range of the sizes of the mount portions of the tools, to which the handle can be applied, can be expanded, so that the versatility of the handle can be improved.

The operation device may further include a fixing screw having a threaded shank, a first actuation member movable in an axial direction of the threaded shank. The operation member includes a nut engaging with the threaded shank, so that the first actuation member moves in the axial direction to cause the clamp halves to be opened or closed as the nut rotates relative to the threaded shank.

With this arrangement, the clamp halves can be moved toward and away from each other by simply rotating the operation member.

The operation device may further include a second actuation member and a third actuation member movable relative to each other in the axial direction of the threaded shank. Each of the clamp halves has a first end and a second end opposite to the first end. The second actuation member is coupled to the first end of one of the clamp halves. The third actuation member is coupled to the first end of the other of the clamp halves. At least one of the second and third actuation members can move in the axial direction in response to the movement of the first actuation member, so that the second and third actuation members can move toward and away from each other.

With this arrangement, the movement of the first actuation member can cause the movement of the second and third actuation members relative to each other.

The handle may further include a latch device disposed between the second ends of the clamp halves and operable to latch and release the second ends against each other, so that the clamp halves can be held in the close position by latching the second ends of the clamp halves against each other and the clamp halves can be opened by releasing the latch device.

The operation device may further include a first support member and a second support member. The first support member slidably supports the second actuation member via an arc-shaped support surface such that the second actuation member can tilt about the center of curvature of the arc-shaped support surface relative to the first support member. The second support member slidably supports the third actuation member via an arc-shaped support surface such that the third actuation member can tilt about the center of curvature of the arc-shaped support surface relative to the second support member.

With this arrangement, it is possible to further increase a tolerance of movement of the clamp halves for opening the clamp halves. Therefore, it is possible to further easily mount and remove the handle. In addition, it is possible to mount the handle to a mount portion that is large in size.

Each of the support arms may have a first end on the side of the operation device and a second end opposite to the first end. The grip portion extends between the second ends of the support arms. A reinforcing rod may be fixed to the first ends of the support arms and may extend therebetween.

With this arrangement, the rigidity of the handle body can be improved. Therefore, the durability of the handle can be improved such that the handle may not be damaged even in the case that the handle has fallen on the ground.

In another embodiment, a handle for a tool includes a handle body, an operation device and a pair of clamp halves. The operation device is coupled to the handle body and includes an operation member. The clamp halves are coupled to the operation device such that at least one of the clamp halves can move relative to the handle body along an axis in response to the operation of the operation member.

The operation device may further include a rod defining the axis and having a threaded portion. The operation member includes a nut in engagement with the threaded portion, so that the nut can move along the axis as the nut rotates relative to the rod. The clamp halves are slidably fitted on the rod.

The operation device may further include an actuation member slidably fitted on the threaded rod and interleaved between the nut and the at least one of the clamp halves.

The rod may have a first end and a second end opposite to the second end. The handle body may have a first arm and a second arm spaced from each other along the axis. The first end of the rod is non-rotatably supported by the first arm of the handle body. The threaded portion is formed on the second end of the rod. The actuation member is slidably fitted on the rod at a position proximal to the second end and is supported by the second arm of the handle body such that the actuation member can move relative to the second arm in the direction of the axis but cannot rotate relative to the second arm.

One of the clamp halves may have a first member, and the other of the clamp halves may have a second member positioned to oppose to the first member in the direction of the axis. The actuation member may oppose to the first member on the side opposite to the second member, so that the first member is moved by the actuation member as the actuation moves along the axis.

The handle may further include rotation preventing members for preventing rotation of the first and second members relative to the handle body.

The clamp halves may have free ends opposite to the first member and the second member, respectively. The handle may further include a latch device for releasably latching the free ends of the clamp halves against each other. Each of the first and second members may be tilted relative to the threaded rod.

In a further embodiment, a handle for a tool includes a handle body, an operation device, a pair of clamp halves and an actuation mechanism. The operation device is coupled to the handle body and includes a support rod and an operation member movably mounted to the support rod. The support rod may be a threaded shank of a screw. The clamp halves are supported on the support rod. At least one of the clamp halves can move along the support rod. The actuation mechanism is interleaved between the operation member and the at least one of the clamp halves, so that the movement of the operation member causes the movement of the at least one of the clamp halves along the support rod.

First to third embodiments of the present invention will now be described with reference to FIGS. 1 to 10. These embodiments relates to handles that can be mounted to a front case 2 of many hand-held tools. Therefore, the description of the hand-held tool 1 and the front case 2 is omitted. In addition, in FIGS. 1 to 10, only the front case 2 is shown simply as a circle and the hand-held tool 1 is not shown in detail.

In addition, each of the embodiments will be described in connection with the front case 2 that has a relatively large size and the front case 2 that has a relatively small size. Therefore, in order to distinguish them from each other, the front case 2 having a relatively large size will be labeled with "2L", and the front case 2 having a relatively small size will be labeled with "2S".

First Embodiment

Figure 2:
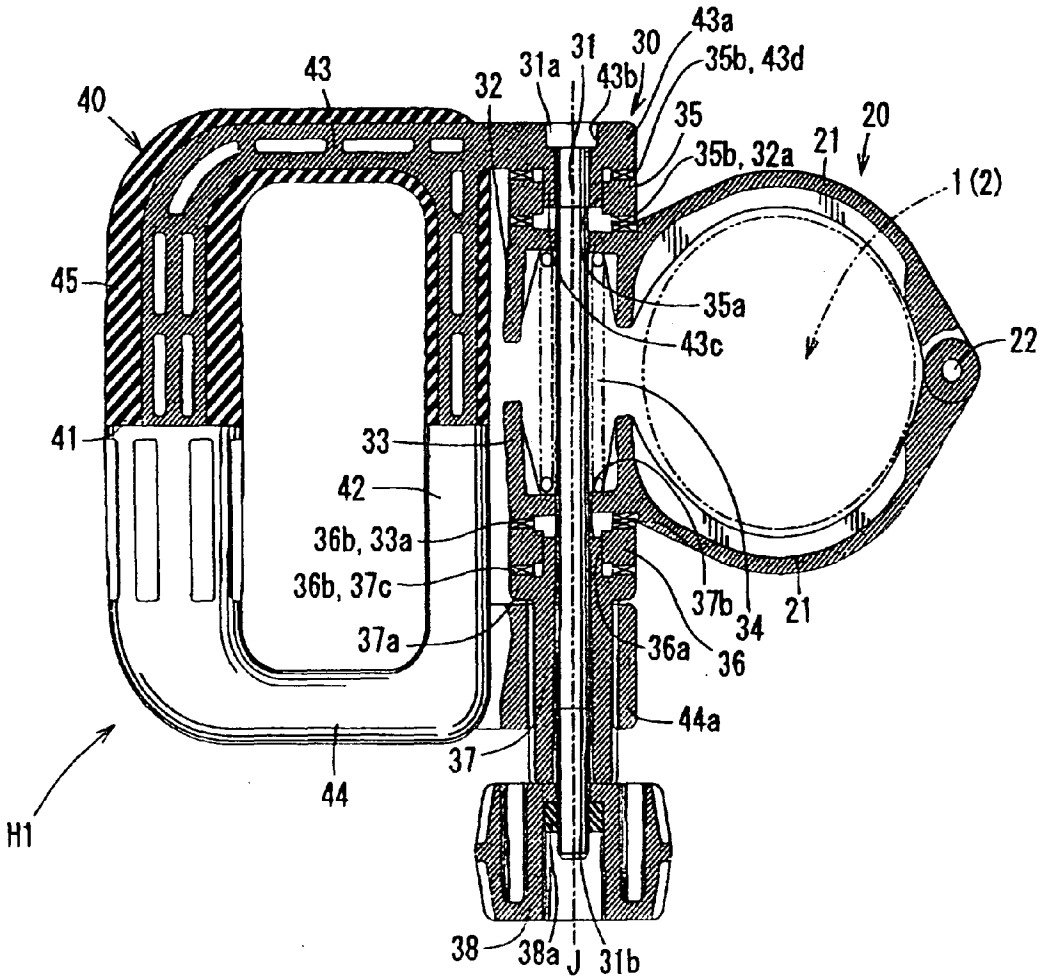
FIG. 2 is a side view similar to FIG. 1 but showing the state where the handle has been removed by loosening the operation knob for opening the clamp halves.
Figure 3:
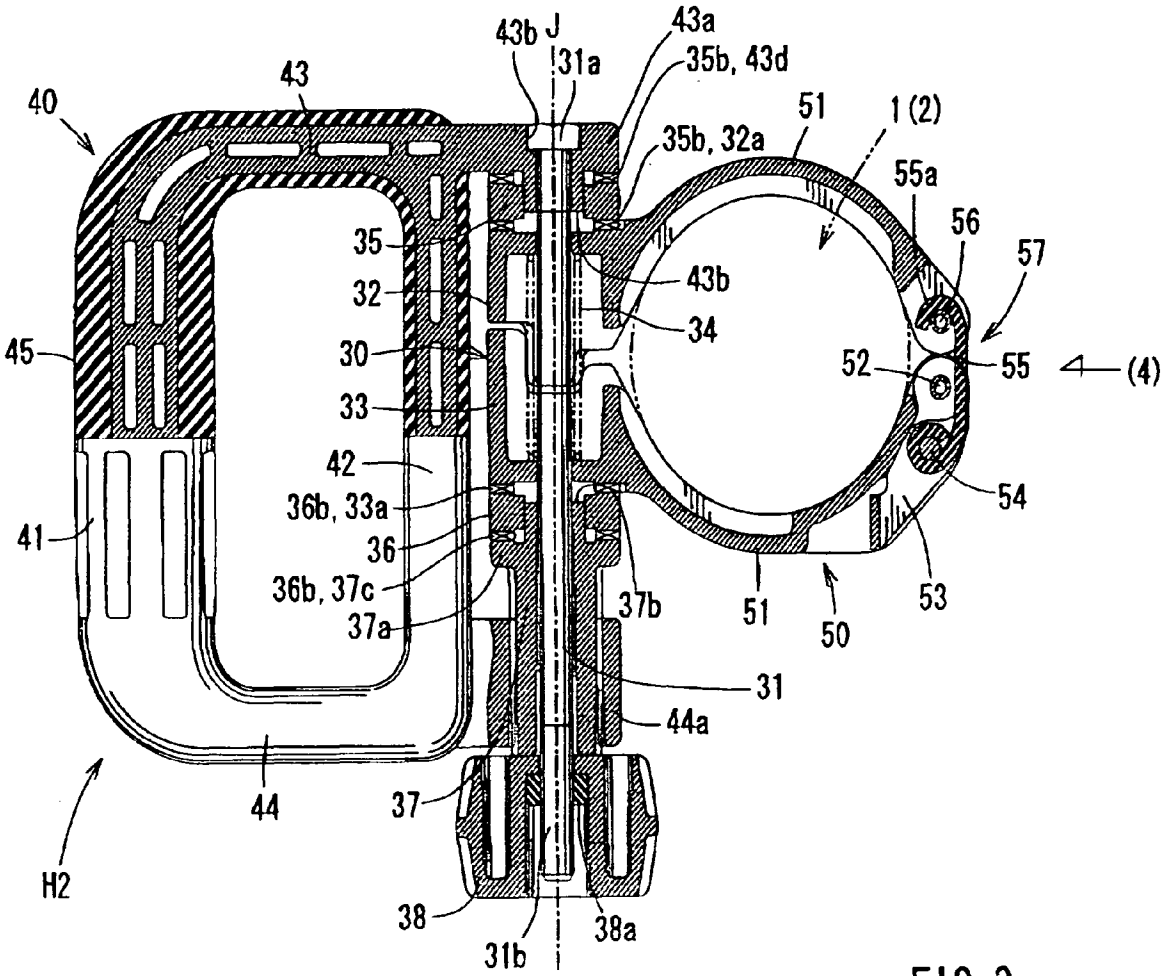
FIG. 3 is a side view of a handle according to a second embodiment of the present invention and showing the state where the handle has been mounted to a mount portion of a hand-held tool by tightening an operation knob and by latching clamp halves by a latch device.
Figure 4:
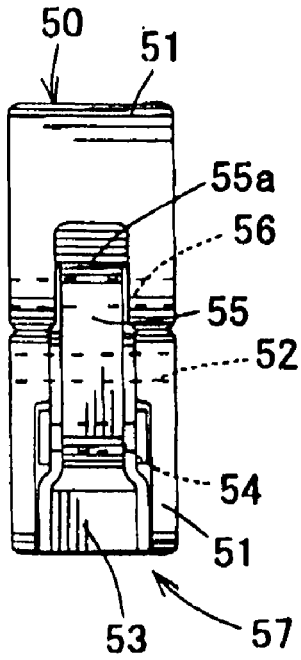
FIG. 4 is a front view of the latch device as viewed in a direction of arrow (4) in FIG. 3.
Figure 5:
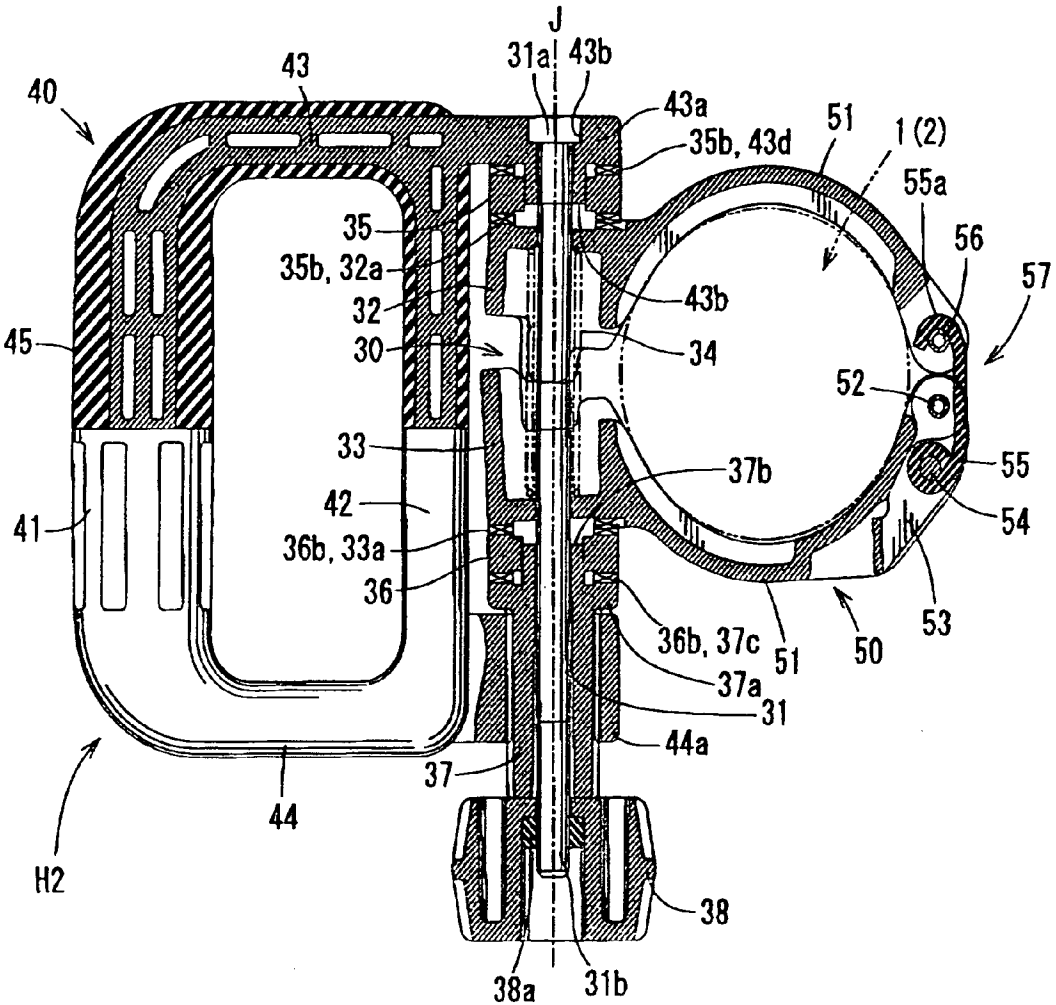
FIG. 5 is a side view similar to FIG. 3 but showing the state where the operation knob has been loosened while the clamp halves are latched by the latch device.
Figure 6:
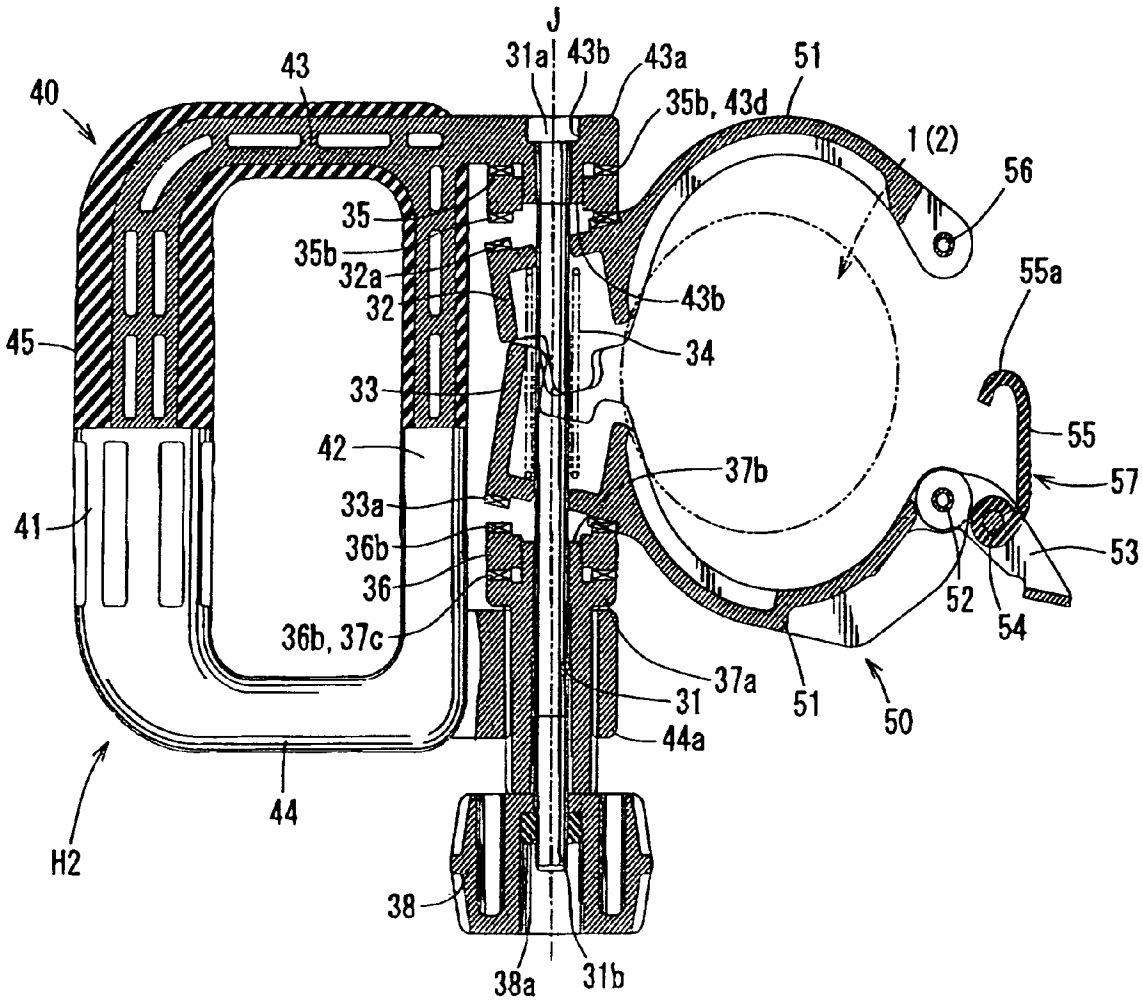
FIG. 6 is a side view similar to FIG. 3 but showing the state where the operation knob has been loosened and the clamp halves are opened by unlatching the latch device, so that the handle can be removed.

A first embodiment will now be described with reference to FIGS. 1 and 2. A handle H1 shown in FIGS. 1 and 2 generally includes a clamp portion 20, an operation device 30 and a handle body 40. The operation device 30 is operable to open and close the clamp portion 20. The handle body 40 is coupled to the clamp portion 20 via the operation device 30.

The clamp portion 20 has a pair of clamp halves 21 that can clamp the front case 2 of the hand-held tool 1 therebetween from opposite sides, so that the front case 2 can be fixed in position relative to the clamp portion 20. The clamp halves 21 are opposed to each other and each has a substantially semicircular arc-shaped configuration that has a radius substantially conforming to the radius of an outer contour of the front case 2 (e.g., the front case 2S). Therefore, the handle H1 can be mounted to the front case 2 when the clamp halves 21 clamp the front case 2 from opposite sides. Therefore, the front case 2 serves as a mount portion, to which the handle H1 is mounted.

One end (left end as viewed in FIGS. 1 and 2) of each of the clamp halves 21 is coupled to the operation device 30. The other ends of the clamp halves 21 are pivotally joined to each other via a joint pin 22, so that the clamp halves 21 can be opened and closed in the vertical direction as viewed in FIGS. 1 and 2.

The operation device 30 is operable to move the clamp halves 21 toward and away from each other in order to open and close the clamp halves 21 relative to the front case 2. The operation device 30 includes a fixing screw 31 and a pair of actuation members 32 and 33. The actuation members 32 and 33 can move toward and away from each other along an axis J of the fixing screw 31. The actuation member 32 is formed integrally with one end of the one of the clamp halves 21. The actuation member 33 is formed integrally with one end of the other of the clamp halves 21. A compression spring 34 is interleaved between the actuation members 32 and 33 and serves to bias the actuation members 32 and 33 in directions away from each other.

The handle body 40 is coupled to the clamp portion 20 via the operation device 30. The operation device 30 has a function for moving the clamp halves 21 of the clamp portion 20 in the opening and closing directions and also has a function for preventing the handle body 40 from rotating relative to the clamp portion 20 about the axis J of the fixing screw 31.

The handle body 40 has a pair of support arms 43 and 44. The support arms 43 and 44 extend laterally (leftward as viewed in FIGS. 1 and 2) from the handle body 40 and are spaced from each other by a predetermined distance. A rotation preventing member 35 is interleaved between a base end 43*a* of the support arm 43 and the actuation member 32 that are positioned on the upper side as viewed in FIGS. 1 and 2. A rotation preventing member 36 and an intermediate actuation member 37 are interleaved between a base end 44*a* of the support arm 44 and the actuation member 33 that are positioned on the lower side as viewed in FIGS. 1 and 2.

The fixing screw 31 extends between the base ends 43*a* and 44*a* of the upper and lower support arms 43 and 44. In addition, the fixing screw 31 extends through the central portions of the upper and lower rotation preventing members 35 and 36, the upper and lower actuation members 32 and 33, and the intermediate actuation member 37. The fixing screw 31 has a head 31*a* that is received within a recess 43*b* formed within the base end 43*a* of the upper support arm 43, so that the fixing screw 31 is prevented from rotating relative to the upper support arm 43 about the axis J. A threaded shank 31*b* of the fixing screw 31 has a lower end that extends downward beyond the lower end of the intermediate actuation member 37. An operation knob 38 is attached to the lower end of the threaded shank 31*b*. A fixing nut 38*a* is mounted within the operation knob 38 and is engagement with the threaded shank 31*b*.

The upper and lower rotation preventing members 35 and 36 have central insertion holes 35*a* and 36*a*, respectively. Each of the upper and lower rotation preventing members 35 and 36 has an annular configuration. A plurality of engaging projections 35*b* are formed on each of opposite end faces in the axial direction of the upper rotation preventing member 35. The engaging projections 35*b* are arranged in the circumferential direction about the axis J. Similarly, a plurality of engaging projections 36*b* are formed on each of opposite end faces in the axial direction of the lower rotation preventing member 36 and are arranged in the circumferential direction about the axis J.

A support boss portion 43*c* is formed on the base end 43*a* of the upper support arm 43 and is inserted into the insertion hole 35*a* of the upper rotation prevention member 35. Therefore, the rotation prevention member 35 is supported by the support boss portion 43*c* such that the rotation prevention member 35 can rotate about the axis J relative to the support boss portion 43*c*.

A plurality of engaging projections 43*d* are formed on an end face of the base end 43*a* of the upper support arm 43, which end face is positioned around the support boss portion 43*c* and is opposed to the engaging projections 35*b* formed on the upper side of the upper rotation preventing member 35. When the upper engaging projections 35*b* and the engaging projections 43*d* are in engagement with each other, the upper rotational preventing member 35 can be prevented from rotating about the axis J relative to the upper support arm 43.

A plurality of engaging projections 32*a* are formed on the upper face of the upper actuation member 32, which upper face opposes to the engaging projections 35*b* formed on the lower side of the upper rotation preventing member 35. When the lower engaging projections 35*b* and the engaging projections 32*a* are in engagement with each other, the upper actuation member 32 and eventually the corresponding clamp half 21 can be prevented from rotating about the axis J relative to the upper rotation preventing member 35. When the upper engaging projections 35*b* and the engaging projections 43*d* are also in engagement with each other, the upper actuation member 32 and eventually the corresponding clamp half 21 can be prevented from rotating about the axis J relative to the support arm 43.

A flange 37*a* is formed on the upper portion of the intermediate actuation member 37 and has a support boss portion 37*b* protruding upwardly from the central portion of the flange 37*a*. The support boss portion 37*b* is inserted into the insertion hole 36*a* of the lower rotation preventing member 36. Therefore, the lower rotation preventing member 36 is supported by the support boss portion 37*b* such that the lower rotation preventing member 36 can move relative to the flange 37 in the direction of the axis J and can rotate relative to the flange 37 about the axis J. A plurality of engaging projections 37*c* are formed on the upper face of the flange 37*a*, which upper face is positioned around the support boss portion 37*b* and is opposed to the engaging projections 36*b* formed on the lower side of the lower rotation preventing member 36. The engaging projections 37*c* are arranged in the circumferential direction of the upper face of the flange 37*a*. When the lower engaging projections 36*b* and the engaging projections 37*c* are in engagement with each other, the lower rotational preventing member 36 can be prevented from rotating about the axis J relative to the intermediate actuation member 37.

A plurality of engaging projections 33*a* are formed on the lower face of the lower actuation member 33, which lower face opposes to the engaging projections 36*b* formed on the upper side of the lower rotation preventing member 36. When the upper engaging projections 36*b* and the engaging projections 33*a* are in engagement with each other, the lower actuation member 33 and eventually the corresponding clamp half 21 can be prevented from rotating about the axis J relative to the lower rotation preventing member 36.

Therefore, when the fixing nut 38*a* is loosened enough to disengage the engaging projections 35*b* of the upper rotation preventing member 35 from the engaging projections 43*d* and/or the engaging projections 32*a* and to disengage the engaging projections 36*b* of the lower rotation preventing member 36 from the engaging projections 33*a* and/or the engaging projections 37*c*, the handle body 40 can be rotated about the axis J relative to the clamp portion 20. Therefore, it is possible to move the handle body 40 at an arbitrary position about the axis J and to fix the handle body 40 in that position. This allows the handle body 40 to be mounted to the front case 2 (i.e., a mount portion for mounting the handle H1) of the hand-held tool 1 in such a state where the handle body 40 is tilted forwardly or rearwardly relative to the front case 2. Therefore, the operability of the handle H1 can be improved.

The intermediate actuation member 37 is coupled to the base end 44*a* of the lower support arm 44 via a spline coupling, so that the intermediate actuation member 37 can move relative to the base end 44*a* in the direction of the axis J but cannot rotate relative to the base end 44*a* about the axis J.

With the above construction, as the operator rotates the operation knob 38 in one direction (hereinafter called "mounting direction"), the fixing nut 38*a* rotates in a tightening direction relative to the threaded shank 31*b* of the fixing screw 31, so that the distance between the head 31*a* of the fixing screw 31 and the knob 38 decreases. Hence, the intermediate actuation member 37 moves upward as viewed in FIGS. 1 and 2, so that the upper and lower actuation members 32 and 33 move toward each other against the biasing force of the compression spring 34. As a result, the clamp halves 21 pivot about the joint pin 22 and move toward each other so as to be closed. Therefore, the handle H1 can be fixed in position relative to the front case 2 of the hand-held tool 1. FIG. 1 shows this mounted state of the handle H1.

On the other hand, as the operator rotates the operation knob 38 in a reverse direction (hereinafter called "removing direction"), the fixing nut 38*a* rotates in a loosening direction relative to the threaded shank 31*b* of the fixing screw 31, so that the distance between the head 31*a* of the fixing screw 31 and the knob 38 increases. Hence, the intermediate actuation member 37 moves downward as viewed in FIGS. 1 and 2, so that the lower actuation member 33 moves downward away from the upper actuation member 32 by the biasing force of the compression spring 34. As a result, the clamp halves 21 pivot about the joint pin 22 to move away from each other so as to be opened. Therefore, the handle H1 can be removed from the front case 2. FIG. 2 shows this removed state of the handle H1.

As described above, by rotating the operation knob 38, it is possible to move the actuation members 32 and 33 toward and away from each other for closing and opening the clamp halves 21. More specifically, the rotation of the operation knob 38 causes the movement of the intermediate actuation member 37 along the axis J, which movement causes the relative movement between the actuation members 32 and 33. The intermediate actuation member 37 is supported by the base end 44*a* of the lower support arm 44 such that the intermediate member 37 can move in the direction of the axis J relative to base end 44*a*. Therefore, the intermediate member 37 can move independently of the support arm 44 for opening and closing the clamp halves 21.

In addition, the support arms 43 and 44 of the handle body 40 extend laterally from the operation device 30 and are positioned in parallel to each other. The grip 41 is fixed to the tip ends of the support arms 43 and 44 and extends therebetween. A reinforcing rod 42 is fixed to the base ends of the support arms 43 and 44 and extends therebetween. The reinforcing rod 42 is substantially parallel to the grip 41. With the incorporation of the reinforcing rod 42, the support arms 43 and 44 can be reliably prevented from flexing toward each other.

Further, a rubber cover 45 entirely covers the grip 41 and the reinforcing rod 42 and partially covers the support arms 43 and 44 at a region between the grip 41 and the reinforcing rod 42. The rubber cover 45 is provided mainly for preventing slippage of fingers of the operator. Therefore, a comfortable feeling can be given to the operator during the use of the hand-held tool 1.

As described above, with the handle H1 according to the first embodiment of the present invention, it is possible to move the actuation members 32 and 33 toward and away from each other by rotating the operation knob 38 that serves to tighten and loosen the fixing screw 38*a* against the threaded shank 31*b* of the fixing screw 31. The movement of the actuation members 32 and 33 causes the movement of the clamp halves 21. Therefore, the clamp halves 21 can be closed for clamping the front case 2 or can be opened for permitting removal of the clamp halves 21 from the front case 2. The movement of the actuation member 33 that is positioned on the lower side is caused by the movement of the intermediate actuation member 37 along the axis J, which movement is caused by the rotation of the operation knob 38. The intermediate actuation member 37 is supported by the support arm 44 of the handle body 40 such that the intermediate member 37 can move in the direction of the axis J.

Therefore, the intermediate actuation member 37 can move along the axis J independently of the support arm 44. Because the relative movement between the actuation members 32 and 33 is caused by the movement of the intermediate actuation member 37, no substantial force is applied to flex the support arm 43 (or 44).

Because the distance between the actuation members 32 and 33 can be determined to be enough by suitably setting the movable distance of the intermediate actuation member 37 along the axis J, it is possible to open the clamp halves 21 enough to enable the front case 2 to be easily removed or inserted. Therefore, the handle H1 can be easily removed from and mounted to the hand-held tool 1 without need of disassembling the handle H1.

Further, the open angle of the clamp halves 21 can be determined depending on the moving distance of the intermediate actuation member 37 and not depending on the flexing deformation of the support arms 43 or 44. Therefore, even in the case that the handle H1 is applied to a hand-held tool with a front case having relatively large stepped portions on opposite sides in the forward and rearward directions for preventing removal of the handle H1, the handle H1 can be easily and rapidly mounted and removed. In other words, the handle H1 can be applied to hand-held tools with front cases that include stepped portions having a variety of sizes (diameters). Therefore, the handle H1 can be improved in versatility. In addition, because it is possible to set the size of the step portions to be large enough, accidental removal of the handle H1 from the hand-held tool 1 can be reliably prevented.

Furthermore, because no substantial force is applied to flex the support arms 43 and 44, the handle H1 has an improved durability.

Second Embodiment

A second embodiment of the present invention will now be described with reference to FIGS. 3 to 6. This embodiment is a modification of the first embodiment. Therefore, like members are given the same reference numerals as FIGS. 1 and 2 and the description of these members will not be repeated.

A handle H2 of this embodiment has a clamp portion 50 that is different from the clamp portion 20 of the handle H1 of the first embodiment. More specifically, the clamp portion 50 has clamp halves 51 with end portions (right end portions as viewed in FIG. 3) configured as free ends.

The end portions of the clamp halves 51 can be coupled to each other via a latch device 57. The latch device 57 has a lever 53 and an engaging plate 55. The lever 53 is vertically pivotally supported on the right end portion of the lower clamp half 51 via a support pin 52. The engaging plate 55 is vertically pivotally supported on the lever 53 via a support pin 54. One end of the engaging plate 55 on the side away from the support pin 54 is bent to form a hook 55*a* that has a substantially semicircular arc-shaped configuration. The hook 55*a* can engage a hook pin 56 that is mounted to the right end portion of the upper clamp half 51. The support pin 54 that pivotally supports the engaging plate 54 is positioned on the side opposite to the hook pin 56 with respect to the support pin 52 of the lever 53. With this construction, as the lever 56 pivots in a counterclockwise direction as viewed in FIG. 6 (hereinafter called "releasing direction") about the support pin 52, the support pin 54 moves to rotate about the support pin 52 toward the hook pin 56. Therefore, the hook 55*a* of the engaging plate 55 can be disengaged from the hook pin 56. By disengaging the hook 55*a* from the hook pin 55, the right ends of the upper and lower clamp halves 51 become free from each other.

Also with this embodiment, as the operator rotates the operation knob 38 in the removing direction to loosen the fixing nut 38*a* against the threaded shank 31*b* of the fixing screw 31, the intermediate actuation member 37 moves downward relative to the lower support arm 44. Therefore, the upper and lower actuation members 32 and 33 move away from each other by the biasing force of the compression spring 34, so that the clamp halves 51 are opened.

Also with the handle H2 of this second embodiment, the same operations and advantages as the first embodiment can be achieved. Thus, as the operator rotates the operation knob 38 in the mounting direction to tighten the fixing nut 38*a* against the fixing screw 31, the intermediate actuation member 37 moves upward relative to the base end 44*a* of the support arm 44, so that the upper and lower actuation members 32 and 33 move toward each other to close the clamp halves 51. On the other hand, as the operator rotates the operation knob 38 in the removing direction to loosen the fixing nut 38*a* against the fixing screw 31, the intermediate actuation member 37 moves downward relative to the base end 44*a*, so that the lower actuation member 33 moves downward away from the upper actuation member 32 by the biasing force of the compression spring 34. As a result, the clamp halves 51 are opened.

Because the intermediate actuation member 37 moves relative to the support arm 44 of the handle body 40 as the operation knob 38 is rotated to tighten or loosen the fixing nut 38*a* against the fixing screw 31, it is possible to open and close the clamp halves 51 without causing substantial deformation or flexing of the support arm 44 or the support arm 43. Therefore, the intermediate member 37 can move independently of the support arm 44 for opening and closing the clamp halves 51, so that the clamp halves 51 can be opened enough. As a result, the handle H2 can be easily promptly mounted to or removed from the hand-held tool 1 without need of disassembling the handle H2.

In particular, with the handle H2 of this embodiment, the right ends of the clamp halves 51 become free from each other by releasing the latch device 57. Therefore, it is possible to increase the tolerance of the opening and closing movement of the clamp halves 51. As a result, the handle H2 can be further easily promptly mounted to and removed from the hand-held tool 1. In addition, the range of the sizes of the front case 2, to which the handle H2 can be applied, can be expanded, so that the versatility can be further improved.

Third Embodiment

A third embodiment of the present invention will now be described with reference to FIGS. 7 to 10. Also, this embodiment is a modification of the first embodiment. Therefore, like members are given the same reference numerals as FIGS. 1 and 2 and the description of these members will not be repeated. A handle H3 of this embodiment is different from the handles H1 and H2 of the first and second embodiments in the configuration of the clamp portion and the operation device. In particular, the handle H3 is improved in that the handle H3 can be applied to a more broader range of the sizes of the front case 2 than that available by the handles H1 and H2.

Figure 7:
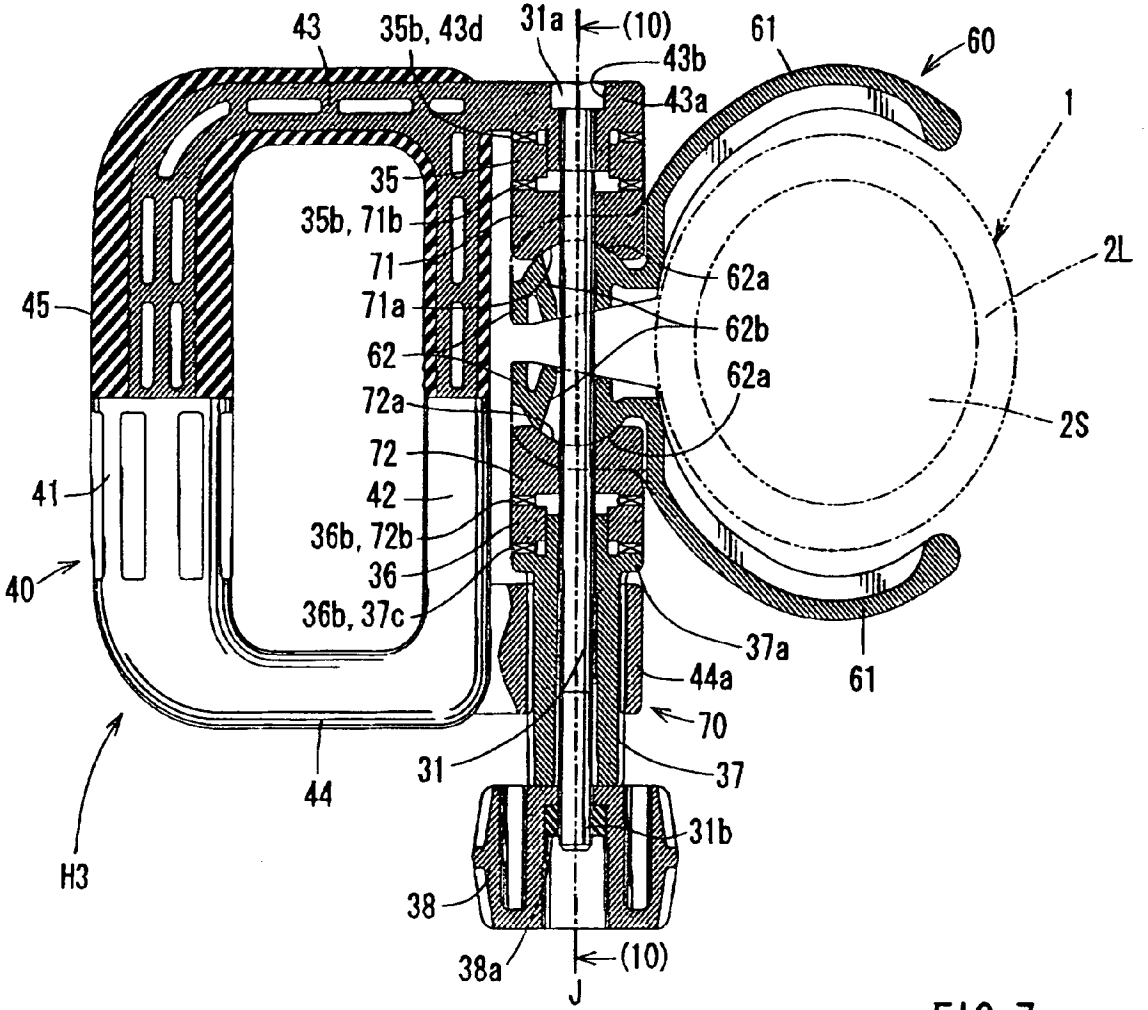
FIG. 7 is a side view of a handle according to a third embodiment of the present invention and showing the state where an operation knob has been loosened for opening clamp halves, so that the handle can be removed from a mount portion of a hand-held tool.

A clamp portion 60 of the handle H3 has a pair of clamp halves 61 each having a substantially semicircular arc-shaped configuration. One end (left end) of the upper clamp half 61 is formed integrally with one of a pair of actuation members 62. Similarly, one end (left end) of the lower clamp half 61 is formed integrally with the other of the pair of actuation members 62. As shown in FIG. 7, each of the clamp halves 61 has a circumferential length enough to extend over the center of the front case 2 but is shorter than the circumferential length of each of the clamp halves 21 and the clamp halves 51. Therefore, in the clamping state of the clamp portion 60, a relatively large space is defined between the right ends of the clamp halves 61.

Similar to the operation device 30 of the first and second embodiments, an operation device 70 of this embodiment includes the fixing screw 31, the upper and lower rotation preventing members 35 and 36, the intermediate actuation member 37 and the operation knob 38. However, in this embodiment, an upper support member 71 is disposed below the upper rotation preventing member 35. In addition, a lower support member 72 is disposed above the lower rotation preventing member 36. The upper and lower actuation members 62 are positioned between the upper and lower support members 71 and 72. The fixing screw 31 extends between the base end 43*a* of the upper support arm 43 and the base end 44*a* of the lower support arm 44 and passes through the central portions of the upper and lower rotation preventing members 35 and 36, the upper and lower support portions 71 and 72, the upper and lower actuation members 62 and the intermediate actuation members 37. Also in this embodiment, the fixing screw 31 is prevented from rotating about the axis J of the threaded shank 31*b*.

Figure 8:
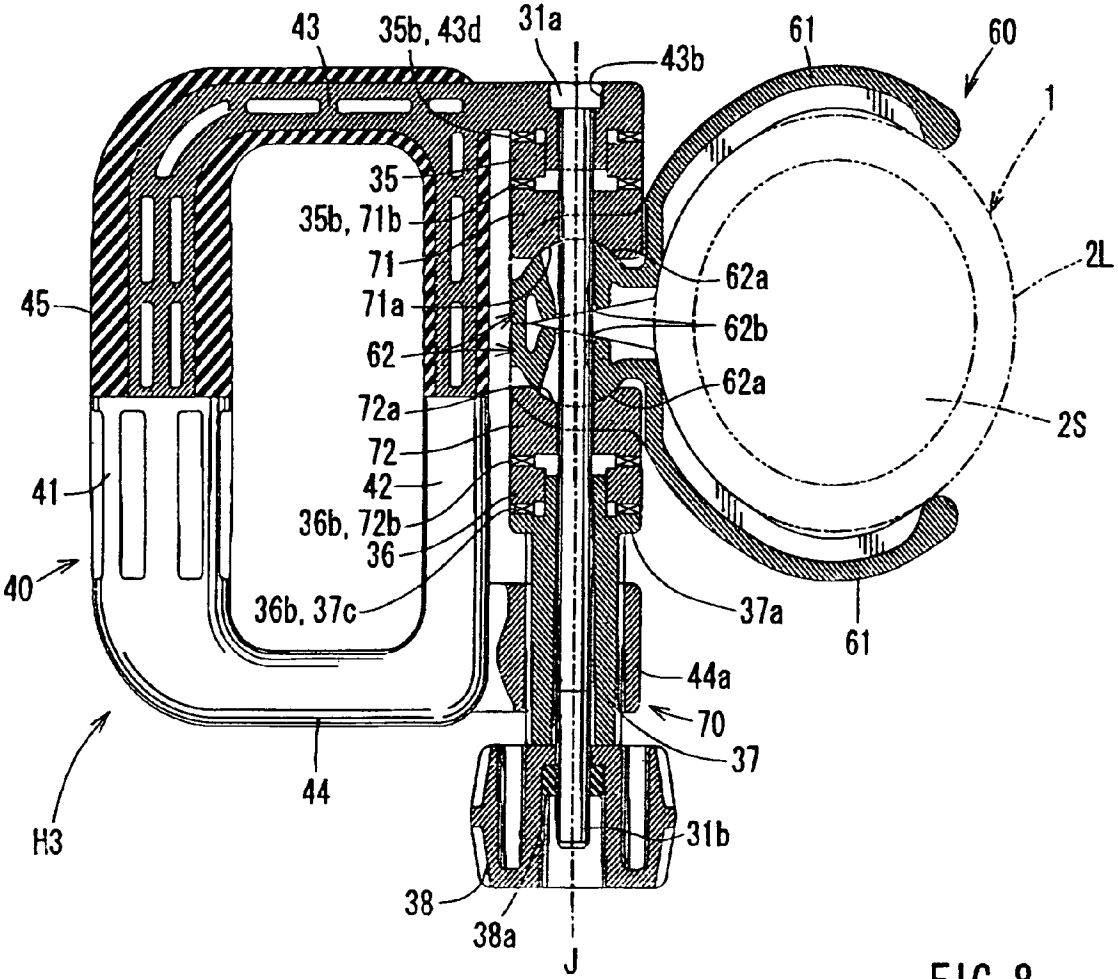
FIG. 8 is a side view similar to FIG. 7 but showing the state where the operation knob has been tightened for clamping a mount portion of a hand-held tool between clamp halves in the case that the mount portion has a relatively large size.
Figure 9:
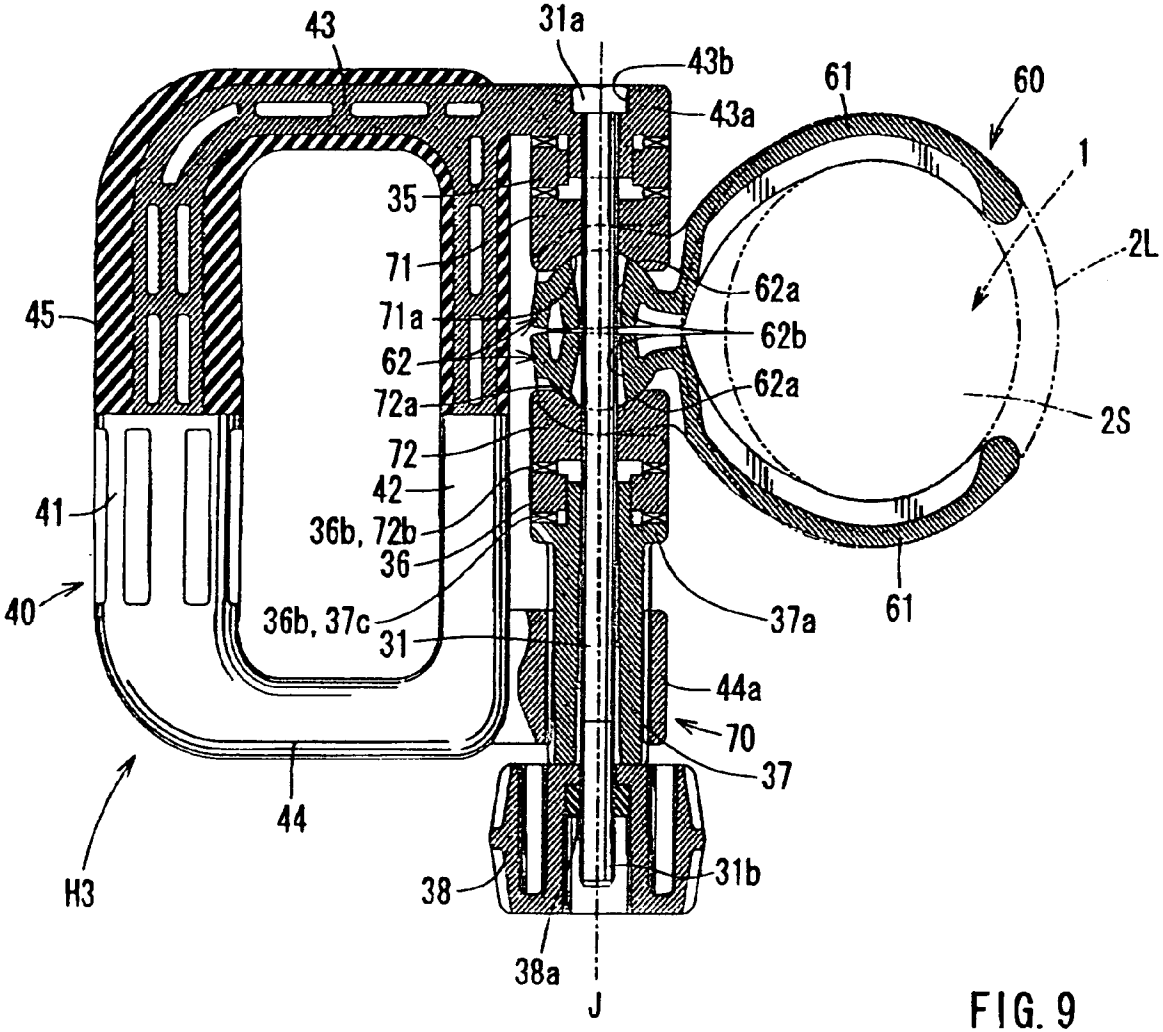
FIG. 9 is a side view similar to FIG. 7 but showing the state where the operation knob has been tightened for clamping a mount portion of a hand-held tool between the clamp halves in the case that the mount portion has a relatively small size.
Figure 10:
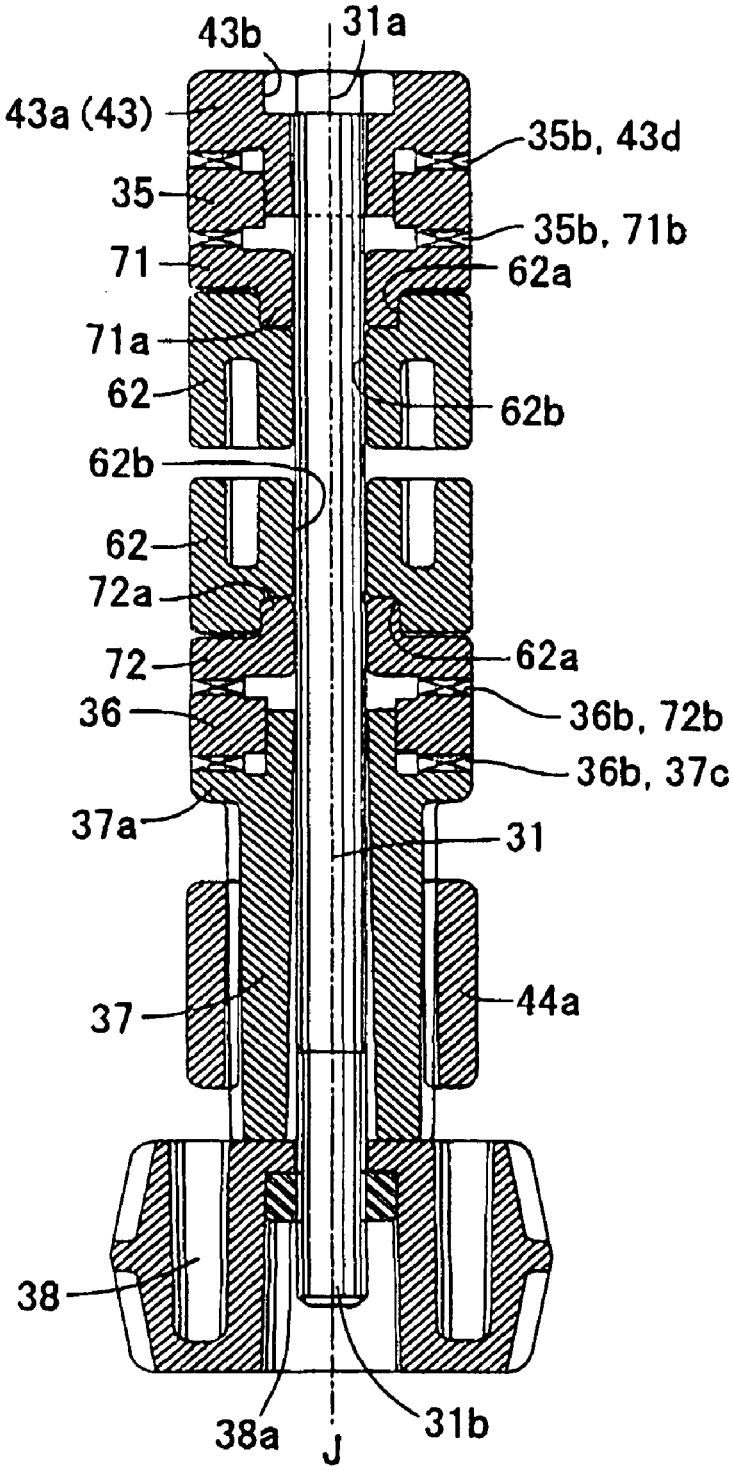
FIG. 10 is a vertical sectional view of an operation device of the handle along line (10)-(10) in FIG. 7.
Figure 11:
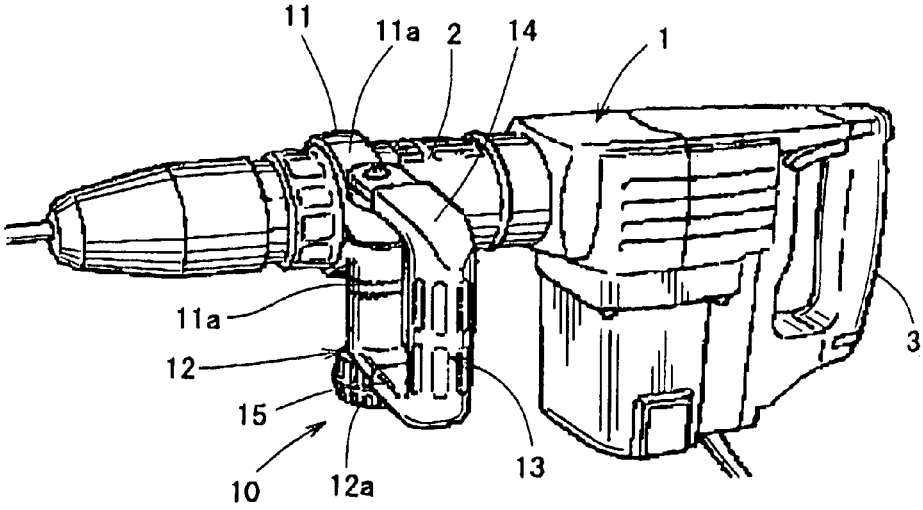
FIG. 11 PRIOR ART
FIG. 11 is a perspective view of a rotary tool having a known handle mounted thereto.

As shown in FIG. 10, a support recess 62*a* is formed in each of the upper surface of the upper actuation member 62 and the lower surface of the lower actuation member 62. As shown in FIGS. 7 to 9, the bottom of the support recess 62*a* is configured as an arc-shaped surface that is convex toward the open side of the support recess 62*a*.

A support projection 71*a* is formed on the lower surface of the upper support member 71 and has a width in the right and left directions as viewed in FIG. 10. The width of the support projection 71*a* is determined such that the support projection 71*a* can be inserted into the corresponding support recess 62*a* without substantial play in the widthwise direction. Similarly, a support projection 72*a* is formed on the upper surface of the lower support member 72 and has a width in the right and left directions as viewed in FIG. 10. The width of the support projection 72*a* is determined such that the support projection 72*a* can be inserted into the corresponding support recess 62*a* without substantial play in the widthwise direction. Each of the upper surface of the support projection 71*a* and the lower surface of the support projection 72*a* is configured as a concave surface for slidably contacting with the arc-shaped bottom surface of the corresponding support recess 62*a*.

In this way, the support projections 71*a* and 72*b* of the upper and lower support members 71 and 72 are supported within the corresponding support recesses 62*a* formed in the upper and lower actuation members 62. Therefore, the clamp halves 61 can be opened and closed by a large angle.

In this connection, an insertion hole 62*b* formed in each of the actuation members 62 for insertion of the threaded shank 31*b* of the fixing screw 31 is configured to have a substantially sectorial configuration that is open toward the corresponding support member 71 or 72 as viewed in FIGS. 7 to 9, so that the actuation members 62 and eventually the clamp halves 61 can tilt in opening and closing directions (upper and lower directions as viewed in FIGS. 7 to 9).

Because the support projections 71*a* and 72*a* are inserted into the corresponding support recesses 62*a* without substantial play in the widthwise direction (right and left directions as viewed in FIG. 10), the clamp halves 61 can be prevented from moving or tilting in the widthwise direction (i.e., a direction perpendicular to the sheet of each of FIGS. 7 to 9).

The upper support member 71 and the upper rotation preventing member 35 can be prevented from rotating about the axis J relative to each other by the engagement between engaging projections 71*b* (that are similar to the engaging projections 32*a*) and the engaging projections 35*b*. The lower support member 72 and the lower rotation preventing member 36 can be prevented from rotating about the axis J relative to each other by the engagement between engaging projections 72*b* (that are similar to the engaging projections 33*a*) and the engaging projections 36*b*. The third embodiment is similar to the first and second embodiments in this respect. Also, as with the first and second embodiments, the upper rotation preventing member 35 and the base end 43*a* of the upper support arm 43 can be prevented from rotating about the axis J relative to each other by the engagement between the engaging projections 35*b* and the engaging projection 43*d*. In addition, the lower rotation preventing member 36 and the flange 37*a* of the intermediate actuation member 37 can be prevented from rotating about the axis J relative to each other by the engagement between the engaging projections 35*b* and the engaging projections 43*d*.

The clamp portion 60 supports the handle 40 via the operation device 70 configured as described above. As the operation knob 38 of the operation device 70 rotates, the fixing nut 38*a* rotates in the tightening direction against the threaded shank 31*b* of the fixing screw 31, so that the distance between the operation knob 38 and the base end 43*a* decreases to cause movement of the intermediate actuation member 37 upward relative to the lower base end 44*a*. As a result, the actuation members 62 move toward each other.

The actuation members 62 are supported by the corresponding support portions 71 and 72 of the operation device 70 such that the actuation members 62 can tilt relative to the corresponding support portions 71 and 72 within a predetermined angular range through contact between the arc-shaped concave and convex surfaces. Here, the centers of the arc-shaped concave and convex surfaces are positioned on the axis J of the threaded shank 31*b*. Therefore, when the tightening force of the fixing nut 38*a* is applied in the direction of the axis J with the actuation members 62 tilted at an arbitrary tilt angle, no force is applied to the actuation members 62 from any direction other than the direction along the axis J. Therefore, it is possible to reliably fix the front case 2 of the hand-held tool 1 in position with the clamp halves 21 positioned at suitably tilted positions depending on the size (diameter) of the front case 2.

Thus, according to this embodiment, it is possible to mount the handle H3 to hand tools with front cases that have a variety of sizes, such as the front case 2L and the front case 2S shown in FIGS. 7 to 9. In addition, it is possible to easily mount and remove the handle H3 by opening the clamp halves 61 by a large angle without need of disassembling the handle H3.

As described above, the clamp halves 61 of the handle H3 of this embodiment can be opened by a large angle by rotating the operation knob 38 without need of disassembling the handle H3. Therefore, the mounting and removing operation of the handle H3 can be easily rapidly performed.

In addition, because the clamp halves 61 can be opened by a large angle and can be set to a desired open angle for clamping the front case 2 (i.e., the mount portion for mounting the handle H3), the versatility of the handle H3 can be further improved.

Other Possible Modifications

The present invention may not be limited to the above embodiments but may be modified in various ways. For example, although the handle H1 (or H2 or H3) is mounted to the front case 2 with the handle positioned on the left side of the front case 2, it is possible to position the handle on the right side of the front case 2 by loosening the fixing nut 38*a* and rotating the entire handle about the front case 2. Because the handle body 40 can be positioned in either the left side or the right side in this way, the handle can be used by both of right-handed operators and left-handed operators. In the case that the handle body 40 has been positioned on the right side, the operation knob 38 may be positioned on the upper side of the handle.

In the above embodiment(s), the rotation preventing member 35 is provided between the support arm 43 and the actuation member 32 (62) for preventing rotation of the handle body 40 about the axis J relative to the clamp portion 20 (50, 60). Also, the rotation preventing member 36 is provided between the support arm 44 and the actuation member 36 (62) for preventing rotation of the handle body 40 about the axis J relative to the clamp portion 20 (50, 60). However, the rotation preventing members 35 and 36 may be omitted. For example, it is possible that only the tightening force of the fixing nut 38*a* prevents the rotation. Otherwise, the rotation preventing members 35 and 36 may be replaced with any other rotation preventing devices.

Although the handles H1, H2 and H3 are described for use as auxiliary handles that are mounted to the front portion of the hand-held tool 1, the handles H1, H2 and H3 can be mounted to the rear portion of the hand-held tool 1 for use as main handles.

In addition, in the first and second embodiments, the compression spring 34 may be omitted. Further, although the intermediate actuation member 37 is coupled to the base end 44*a* of the lower support arm 44 via a spline coupling, it is possible to use any other coupling device, such as a key, in order to couple the intermediate actuation member 37 to the base end 44*a* such that the intermediate actuation member 37 cannot rotate relative to the base end 44*a* but can move in the direction of the axis J. Furthermore, the reinforcing rod 42 may be omitted.

Although the intermediate actuation member 37 is provided only between the base end 44*a* of the lower support arm 44 and the rotation preventing member 36, an intermediate actuation member similar to the intermediate actuation member 37 can be provided between the base end 43*b* of the upper support arm 43 and the rotation preventing member 35. However, in such a case, means for positioning the handle body 40 with respect to the direction of the axis J may preferably be provided. The fixing screw 31 may be replaced with a rod that has an upper end fixedly attached to the base end 44*a* and has a threaded portion at its lower portion for engagement with the nut 38*a*.

This invention claims:

1. A handle for a hand-held tool, comprising:

a pair of clamp halves capable of clamping and fixing a mount portion of the hand-held tool from opposite sides of the mount portion;

an operation device including an operation member capable of opening and closing the clamp halves relative to the mount portion; and a handle body configured to be grasped by an operator; wherein:

the handle body comprises a pair of support arms and a grip portion;

the support arms are configured to support the operation device;

the grip portion extends between the support arms;

the operation device is configured such that the clamp halves can move to open or close relative to the mount portion independently of the support arms;

the operation device includes:

a fixing screw having a threaded shank; and a first non-elastically deformable actuation member movable in an axial direction of the threaded shank;

the operation member comprises a nut engaging with the threaded shank, so that the first non-elastically deformable actuation member moves in the axial direction to cause the clamp halves to be opened or closed as the nut rotates relative to the threaded shank; and the first non-elastically deformable actuation member is positioned on one side of the nut in the axial direction and between the nut and both clamp halves.

2. The handle as in claim 1, wherein:

the operation device further comprises a second actuation member and a third actuation member movable relative to each other in the axial direction of the threaded shank;

each of the clamp halves has a first end and a second end opposite to the first end;

the second actuation member is coupled to the first end of one of the clamp halves;

the third actuation member is coupled to the first end of the other of the clamp halves;

at least one of the second and third actuation members can move in the axial direction in response to the movement of the first non-elastically deformable actuation member, so that the second and third actuation members can move toward and away from each other.

3. The handle as in claim 2, further comprising a latch device disposed between the second ends of the clamp halves and operable to latch and release the second ends against each other, so that the clamp halves can be held in the close position by latching the second ends of the clamp halves against each other and the clamp halves can be opened by releasing the latch device.

4. The handle as in claim 2, wherein the operation device further comprises:

a first support member constructed to slidably support the second actuation member via an arc-shaped support surface such that the second actuation member can tilt about the center of curvature of the arc-shaped support surface relative to the first support member; and a second support member constructed to slidably support the third actuation member via an arc-shaped support surface such that the third actuation member can tilt about the center of curvature of the arc-shaped support surface relative to the second support member.

5. The handle as in claim 1, wherein:

each of the support arms has a first end disposed on the side of the operation device and a second end opposite to the first end; and the grip portion extends between the second ends of the support arms.

6. The handle as in claim 5, further comprising a reinforcing rod fixed to the first ends of the support arms and extending therebetween.

7. A handle for mounting to a tool, comprising:

a handle body;

an operation device coupled to the handle body and comprising an operation member; and a pair of clamp halves configured to clamp the tool therebetween;

wherein the clamp halves are coupled to the operation device such that at least one of the clamp halves can move relative to the handle body along an axis in response to the operation of the operation member;

the operation device further comprises a rod and a non-elastically deformable actuation member, the rod defining the axis and including a threaded portion;

the operation member comprises a nut in engagement with the threaded portion of the rod, so that the nut can move along the axis as the nut rotates relative to the rod;

the clamp halves are slidably fitted on the rod;

the non-elastically deformable actuation member is slidably fitted on the rod and interleaved between the nut and the at least one of the clamp halves; and the non-elastically deformable actuation member is positioned on a side of the nut in an axial direction of the support rod and between the nut and both clamp halves.

8. The handle as in claim 7, wherein:

the rod has a first end opposite to a second end;

the handle body has a first arm and a second arm spaced from each other along the axis;

the first end of the rod is non-rotatably supported by the first arm of the handle body;

the threaded portion is formed at the second end of the rod;

the non-elastically deformable actuation member is slidably connected to the rod at a position proximal to the second end;

the non-elastically deformable actuation member is supported by the second arm of the handle body such that the non-elastically deformable actuation member can move relative to the second arm in the direction of the axis but cannot rotate relative to the second arm.

9. The handle as in claim 7, wherein:

one of the clamp halves has a first member;

the other of the clamp halves has a second member positioned to oppose to the first member in the direction of the axis;

the non-elastically deformable actuation member opposes to the first member on the side opposite to the second member, so that the first member is moved by the non-elastically deformable actuation member as the non-elastically deformable actuation member moves along the axis.

10. The handle as in claim 9, further comprising rotation preventing members for preventing rotation of the first and second members relative to the handle body.

11. The handle as in claim 9, wherein:

the clamp halves have free ends opposite to the first member and the second member, respectively; and the handle further comprises a latch device for releasably latching the free ends of the clamp halves against each other.

12. The handle as in claim 9, wherein each of the first and second members can be tilted relative to the rod.

13. A handle for mounting to a tool, comprising:

a handle body;

an operation device coupled to the handle body and comprising a support rod and an operation member movably mounted to the support rod;

a clamp configured to clamp the tool and supported on the support rod;

wherein:

the clamp includes first and second clamp members and at least one of the first and second clamp members can move along the support rod;

an actuation mechanism comprising a non-elastically deformable actuation member positioned between the operation member and the at least one of the first and second clamp members, so that the movement of the operation member causes the movement of the at least one of the first and second clamp members; and the non-elastically deformable actuation member is positioned on one side of the operation member in an axial direction of the support rod between the operation member and both of the first and second clamp members.

14. A handle for mounting to a tool, comprising:

a handle body;

an operation device coupled to the handle body and comprising an operation member; and a pair of clamp halves configured to clamp the tool therebetween;

wherein the clamp halves are coupled to the operation device such that at least one of the clamp halves can move relative to the handle body along an axis in response to the operation of the operation member;

the operation device further comprises a rod and a non-elastically deformable actuation member, the rod defining the axis and including a threaded portion;

the operation member comprises a nut in engagement with the threaded portion of the rod, so that the nut can move along the axis as the nut rotates relative to the rod;

the clamp halves are slidably fitted on the rod;

the non-elastically deformable actuation member is slidably fitted on the rod and interleaved between the nut and the at least one of the clamp halves;

one of the clamp halves has a first member;

the other of the clamp halves has a second member positioned to oppose to the first member in the direction of the axis; and the non-elastically deformable actuation member opposes to the first member on the side opposite to the second member, so that the first member is moved by the non-elastically deformable actuation member as the non-elastically deformable actuation member moves along the axis.

* * * * *